US012583077B2

(12) United States Patent
Nomura

(10) Patent No.: US 12,583,077 B2
(45) Date of Patent: Mar. 24, 2026

(54) PRODUCTION APPARATUS AND PRODUCTION METHOD

(71) Applicant: Kioxia Corporation, Tokyo (JP)

(72) Inventor: Kazufumi Nomura, Yokkaichi Mie (JP)

(73) Assignee: KIOXIA CORPORATION, Tokyo (JP)

( * ) Notice: Subject to any disclaimer, the term of this patent is extended or adjusted under 35 U.S.C. 154(b) by 206 days.

(21) Appl. No.: 18/178,108

(22) Filed: Mar. 3, 2023

(65) Prior Publication Data

US 2023/0311270 A1 Oct. 5, 2023

(30) Foreign Application Priority Data

Apr. 4, 2022 (JP) ..... 2022-062267

(51) Int. Cl.
*B24B 41/06* (2012.01)
*B24B 49/04* (2006.01)
*B24B 51/00* (2006.01)

(52) U.S. Cl.
CPC ..... *B24B 41/068* (2013.01); *B24B 49/04* (2013.01); *B24B 51/00* (2013.01)

(58) Field of Classification Search
CPC ..... B24B 37/04; B24B 37/042; B24B 37/005; B24B 37/10; B24B 37/107
See application file for complete search history.

(56) References Cited

U.S. PATENT DOCUMENTS

| | | | | |
|---|---|---|---|---|
| 8,403,731 | B2 * | 3/2013 | Hirayama | B24B 41/061 451/414 |
| 2003/0186624 | A1 * | 10/2003 | Koike | B24B 49/04 430/311 |
| 2009/0042488 | A1 * | 2/2009 | Sekiya | B24B 7/228 451/41 |
| 2010/0003908 | A1 * | 1/2010 | Hirayama | B24B 7/228 451/398 |
| 2015/0200144 | A1 | 7/2015 | Jang et al. | |
| 2017/0095902 | A1 * | 4/2017 | Yoshida | B24B 7/228 |
| 2018/0226263 | A1 * | 8/2018 | Yang | H01L 21/6838 |
| 2021/0229228 | A1 * | 7/2021 | Yamahata | H01L 21/68764 |

FOREIGN PATENT DOCUMENTS

| | | | | |
|---|---|---|---|---|
| CN | 210704268 | U | 6/2020 | |
| JP | H11-074242 | A | 3/1999 | |
| JP | 2014-030884 | A | 2/2014 | |
| JP | 2019-111634 | A | 7/2019 | |
| JP | 2021-109297 | A | 8/2021 | |
| WO | WO-0028583 | A1 * | 5/2000 | B24B 37/042 |

* cited by examiner

*Primary Examiner* — Joel D Crandall
(74) *Attorney, Agent, or Firm* — Foley & Lardner LLP

(57) ABSTRACT

A production apparatus includes: a rotating body configured to rotate a grindstone to cut a first surface of an object; a holding unit configured to contact a second surface of the object; and a displacement unit configured to displace at least a portion of the second surface of the object in a rotation axis direction of the rotating body.

10 Claims, 6 Drawing Sheets

PRODUCTION APPARATUS AND PRODUCTION METHOD

CROSS-REFERENCE TO RELATED APPLICATION(S)

This application is based upon and claims the benefit of priority from Japanese Patent Application No. 2022-062267, filed Apr. 4, 2022, the entire contents of which are incorporated herein by reference.

FIELD

Embodiments described herein relate generally to a production apparatus and a production method.

BACKGROUND

In general, a semiconductor wafer, such as a silicon wafer, has a front surface with a semiconductor element, such as an IC, formed thereon and a rear surface. To reach a desired uniform thickness, the semiconductor wafer is ground from the rear surface.

DETAILED DESCRIPTION

Figure 1A:
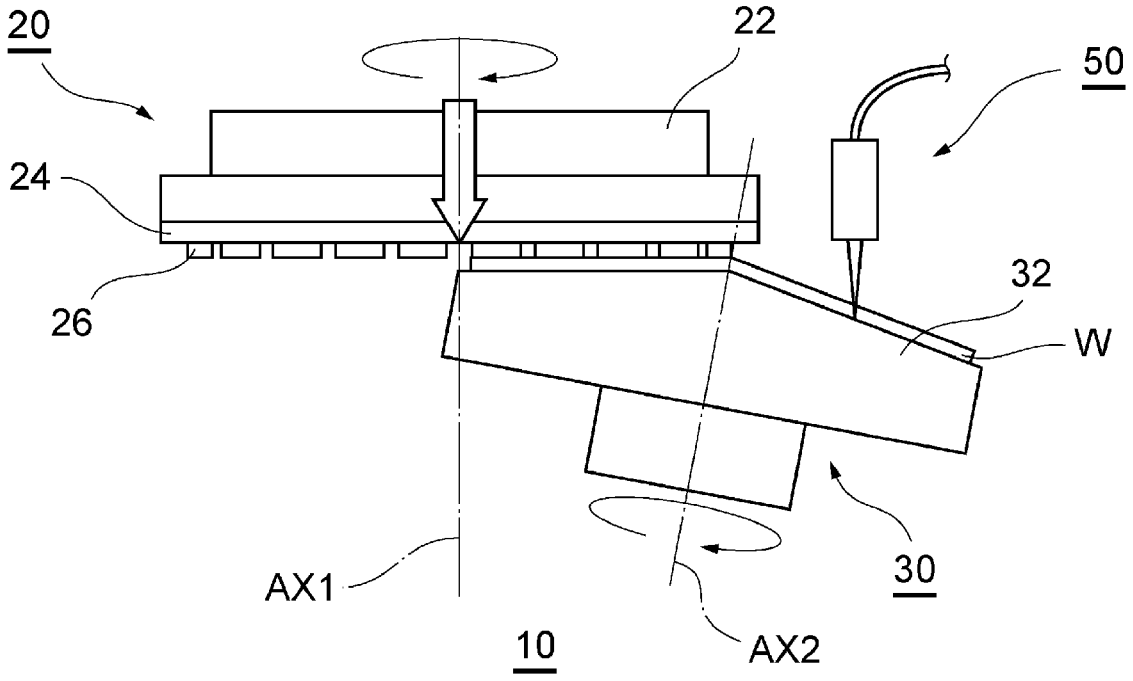
FIG. 1A is a schematic diagram showing principal portions of a grinding apparatus according to one embodiment and FIG. 1B is a plan view showing the relationship between a path through which a grindstone of the grinding apparatus passes and a wafer.

Embodiments provide a production apparatus and a production method, the apparatus and the method which can grind (i.e., cut) the surface of an object to be cut which is formed in the shape of a disk, such as a semiconductor wafer, in such a way that variations in thickness are reduced.

In general, according to one embodiment, a production apparatus including: a rotating body configured to rotate a grindstone to cut a first surface of an object; a holding unit configured to contact a second surface of the object; and a displacement unit configured to displace at least a portion of the second surface of the object in a rotation axis direction of the rotating body.

According to another embodiment, a production apparatus including: a grindstone configured to be able to cut a first surface of a disk-like object to be cut while rotating; a holding unit configured to be able to hold a second surface of the object to be cut; and a displacement unit configured to be able to displace at least part of the second surface of the object to be cut in a rotation axis direction of the rotation is disclosed. This production apparatus includes a semiconductor device production apparatus.

According to still another embodiment, a production method including: cutting a first surface of an object to be cut by rotating a grindstone with a disk-like second surface of the object to be cut being held; acquiring information indicating cutting amounts in a plurality of positions on the cut first surface; displacing the second surface of the object to be cut or at least part of a second surface of a disk-like second object to be cut in a rotation axis direction of the rotation based on the acquired information; and cutting the first surface of the object to be cut or a first surface of the second object to be cut by rotating the grindstone with the displaced second surface of the object to be cut being held or with the displaced second surface of the second object to be cut being held is disclosed. This production method includes a production method for producing a semiconductor device.

Hereinafter, embodiments will be described with reference to the accompanying drawings. To facilitate understanding of explanations, the same element in the drawings is denoted by the same reference sign wherever possible and overlapping explanations are omitted.

First Embodiment

Hereinafter, a grinding (an example of "cutting") apparatus and a grinding method according to the present embodiment will be described. An object to be ground in the present embodiment is made up of two or more silicon wafers which are bonded together and is therefore formed into a disk-like shape (a circular and flat shape) (hereinafter the object to be ground is sometimes referred to simply as the "wafer W"). After the wafer W is ground by the grinding method of the present embodiment, the wafer W is polished (an example of "cutting") by CMP and then divided into a plurality of semiconductor devices by dicing. Therefore, the grinding apparatus and the grinding method according to the present embodiment are production apparatus and method for producing semiconductor devices and other devices.

The present disclosure can also be applied to a downstream process for silicon wafers and other semiconductor wafers. In this case, a semiconductor element is formed on one surface of the semiconductor wafer. In this case, the grinding apparatus according to the present embodiment may be configured to be able to grind the other surface of the semiconductor wafer.

Figure 1B:
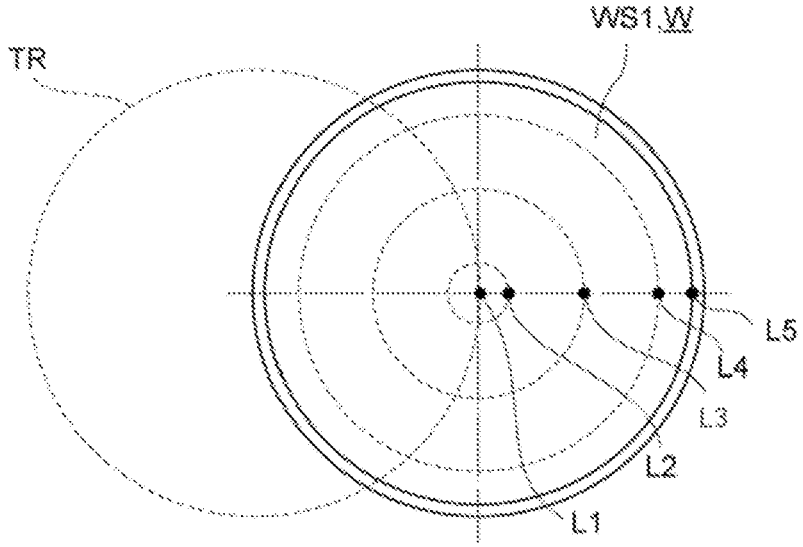
Figure 2:
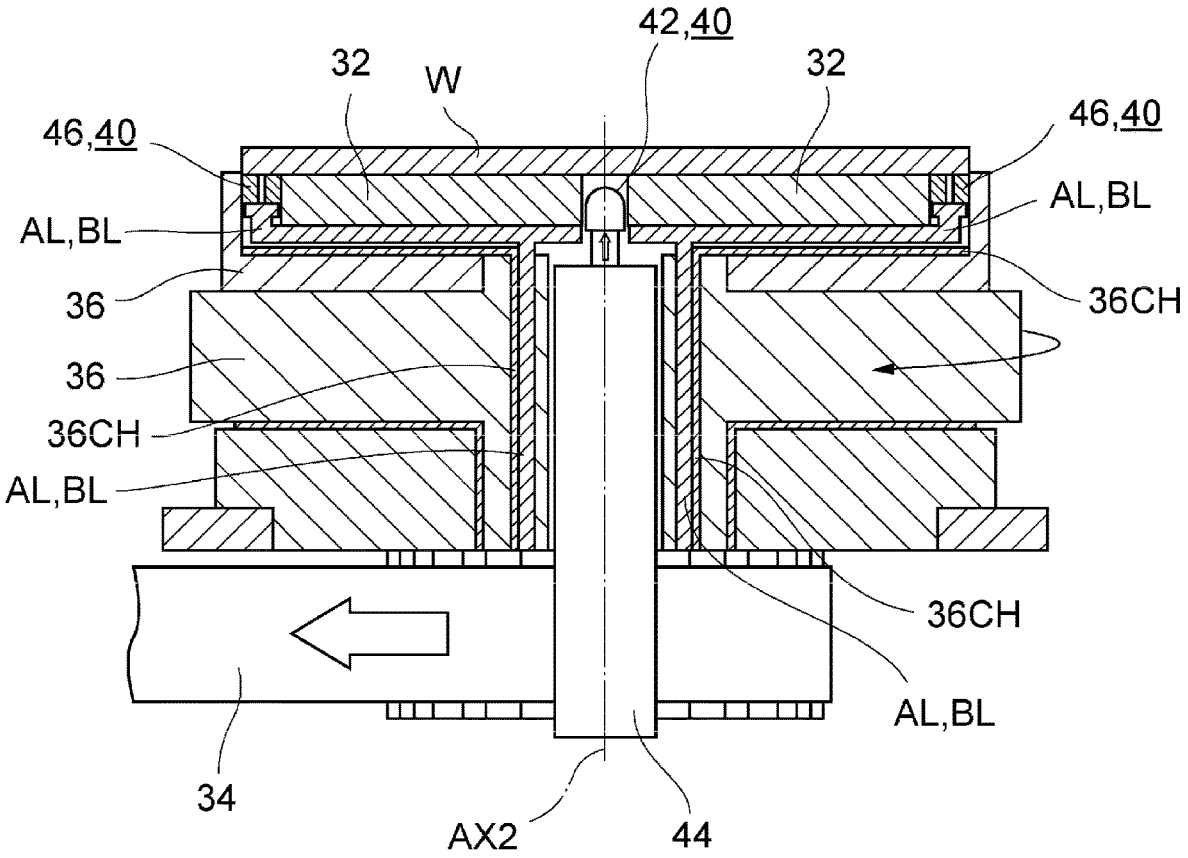
FIG. 2 is a schematic diagram showing a holding portion of the grinding apparatus according to the embodiment.

FIG. 1A is a schematic diagram showing principal portions of a grinding apparatus 10 according to the present embodiment and FIG. 1B is a plan view showing the relationship between a path TR of a grindstone 26 of the grinding apparatus 10 and the wafer W. FIG. 2 is a sectional view schematically showing a holding portion 30 of the grinding apparatus 10 according to the present embodiment.

The grinding apparatus 10 includes a grinding portion 20 for grinding the wafer W, the holding portion 30 for holding the wafer W, a displacement portion 40 (FIG. 2) for displacing the wafer W, and a measuring portion 50 for measuring the grinding amount of the wafer W.

The grinding portion 20 includes a spindle 22 for rotating the grindstone 26, a wheel 24 (an example of a "rotating body") that is integrally rotatable with the spindle 22, and the grindstone 26 attached to the wheel 24 and configured to be able to grind a first surface WS1 of the wafer W while being rotated by the spindle 22.

The holding portion 30 includes a chuck table 32 (an example of a "holding unit") for holding a second surface WS2, which faces the first surface WS1, of the wafer W and a belt 34 for rotating the chuck table 32.

The displacement portion 40 includes an air suction pipe 42 and an adjusting shaft 44 (i.e., a "center displacement unit") for displacing a central part of the second surface WS2 of the wafer W in a normal line direction of the second surface WS2 and an air bag 46 (an example of an "outer displacement unit") configured to be able to displace an outer-side region of the second surface WS2 in the normal line direction of the second surface WS2.

The measuring portion 50 includes a non-contact gage configured to be able to measure the thickness of the wafer W by detecting interference with reflected light, for example. The measuring portion 50 is configured to be able to acquire information reflecting the grinding amount by measuring the film thickness of the wafer W during or after grinding of the wafer W.

As will be described later, a rotation axis AX1 of the wheel 24 and the grindstone 26 held by the wheel 24 and a normal line of the first surface WS1 and the second surface WS2 of the wafer W are nearly parallel. Therefore, displacing the wafer W in the normal line direction of the first surface WS1 or the second surface WS2 corresponds to displacing the wafer W in a rotation axis AX1 direction of the grindstone 26. Hereinafter, each element of the grinding apparatus 10 is described in detail.

The spindle 22 of the grinding portion 20 is configured to be able to rotate about the rotation axis AX1. The spindle 22 can rotate at several thousand rpm, for example. Moreover, the spindle 22 is configured to be able to move in the rotation axis AX1 direction. For example, it is possible to increase the grinding speed and the grinding amount of the wafer W by rotating the spindle 22 with the spindle 22 moved in a direction in which the spindle 22 moves closer to the chuck table 32 in the rotation axis AX1 direction.

The wheel 24 is configured to be able to rotate integrally with the spindle 22 for holding and rotating the grindstone 26. The wheel 24 according to the present embodiment is formed in the shape of an annular ring (a ring) and has grooves formed in a circumferential direction. A plurality of grindstones 26 are fitted into the grooves in such a way as to be separated from each other, whereby the wheel 24 is configured to be able to hold the plurality of grindstones 26.

The grindstone 26 is formed in the shape of a plate using synthetic diamond, for example, and is curved so as to be fitted into the groove formed in the wheel 24. It is to be noted that the elements, such as the spindle 22, the wheel 24, and the grindstone 26, of the grinding portion 20 may be appropriately changed depending on the composition of the object to be ground, a purpose for which the object to be ground is machined, and so forth.

The chuck table 32 of the holding portion 30 is configured to be able to hold at least the second surface WS2 of the wafer W. Moreover, the chuck table 32 is configured to be able to rotate at several hundred rpm, for example. As shown in FIG. 1A, a surface of the chuck table 32 which faces the second surface WS2 of the wafer W is formed in the shape of a cone having the rotation axis AX2 of the chuck table 32 as the axis thereof and including a circular conical surface with the apex on an axis line including the rotation axis AX2 and with an extremely low slope. A cone including a circular conical surface of the chuck table 32 for holding a 300-mm wafer W, for example, has a bottom surface having a diameter of 300 mm or more and a height of 10 to 20 μm. Therefore, the angle of inclination between the generating line and the bottom surface of the cone is less than 0.1°, for example, and the apical angle of the cone is more than 179.9°, for example. Moreover, a through hole extending in a rotation axis AX2 direction is formed at the center of the chuck table 32 including the rotation axis AX2 in order to insert the air suction pipe 42 thereinto.

As shown in FIG. 1A, grinding is performed with the rotation axis AX2 of the chuck table 32 being slightly inclined with respect to the rotation axis AX1 of the wheel 24 such that one of the generating lines of the slightly inclined circular conical surface of the chuck table 32 is nearly orthogonal to the rotation axis AX1 of the wheel 24 when viewed from the side. As a result, the rotation axis AX2 of the chuck table 32 and the rotation axis AX1 of the wheel 24 are nearly parallel (it is noted that the inclination is exaggerated in FIG. 1A). It is to be noted that the holding portion 30 includes a known angle adjusting unit configured to be able to change the rotation axis AX2 of the chuck table 32 with respect to the rotation axis AX1 of the wheel 24.

The chuck table 32 is made of porous ceramic containing pigments, for example, with a surface including the above-described circular conical surface.

The holding portion 30 further includes: a support base 36 that has a vent pipe 36CH formed therein and communicating with the bottom surface of the chuck table 32 and is configured to be able to support the chuck table 32 and rotate integrally with the chuck table 32; the belt 34 for rotating the support base 36 and the chuck table 32 in accordance with the rotation axis AX2 by being engaged in the support base 36; an ejector (not shown in FIG. 2) for generating negative pressure in the vent pipe 36CH; and a rotary driving portion (not shown in FIG. 2) configured with, for example, a motor for rotating the chuck table 32. As shown in FIG. 2, a through hole extending in the rotation axis AX2 direction is formed at the center of the support base 36 including the rotation axis AX2 in order to insert the adjusting shaft 44 (which will be described later) thereinto.

With the chuck table 32 having this configuration, it is possible to hold the wafer W by suction (porous chuck) via gas cavities in a porous body that communicates with the inside of the vent pipe 36CH by generating negative pressure in the vent pipe 36CH.

The displacement portion 40 displaces at least part of the second surface WS2 of the wafer W, which is the object to be ground, in the direction of the rotation axis AX1 of the wheel 24 and the rotation axis AX2 direction. The grinding apparatus 10 according to the present embodiment includes, as a displacement unit, the air suction pipe 42 and the adjusting shaft 44 for displacing a central part of the wafer W in the normal line direction of the surface of the wafer W and the air bag 46 for displacing an outer-side region of the wafer W in the normal line direction of the surface of the wafer W.

Figure 3A:
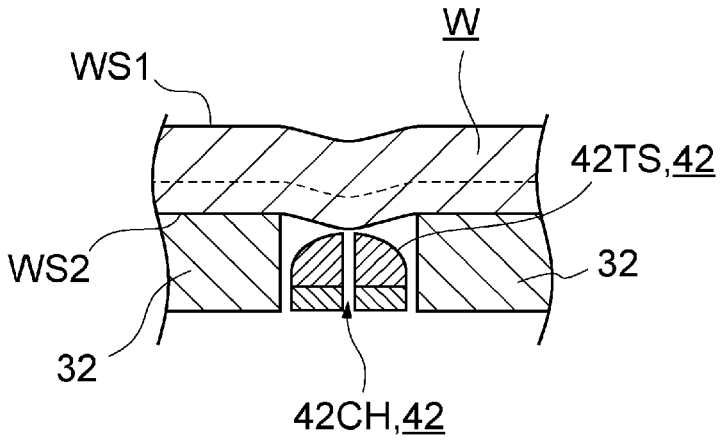
FIGS. 3A to 3C are schematic diagrams showing the displacement of the wafer by an air suction pipe of the grinding apparatus according to the embodiment.
Figure 3B:
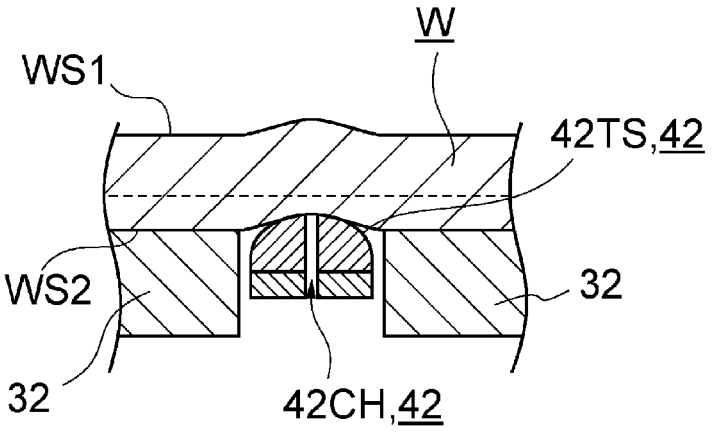

FIGS. 3A and 3B are schematic diagrams showing the displacement of the wafer W by the air suction pipe 42. The air suction pipe 42 (FIG. 2 and FIGS. 3A and 3B) is configured to be able to displace a region including the center of the second surface WS2 of the wafer W in a direction away from the grindstone 26. The air suction pipe 42 according to the present embodiment is inserted into a region in a through hole formed on the rotation axis AX2 of the chuck table 32 and is configured to be able to displace the region including the center of the second surface WS2 of the wafer W in the direction away from the grindstone 26 by holding the wafer W by suction by generating negative pressure in a vent pipe 42CH formed in the air suction pipe 42 in a state in which a tip surface 42TS is close to and faces the second surface WS2 of the wafer W. When the region including the center of the second surface WS2 of the wafer W is displaced in the direction away from the grindstone 26, a region including the center of the first surface WS1 is also displaced in the same direction (FIG. 3A). Therefore, by holding the wafer W by suction by using the air suction pipe 42, it is possible to separate, from the grindstone 26, the region including the center of the first surface WS1 of the wafer W which is being ground and reduce the grinding amount of this region.

The chuck table 32 that holds the second surface WS2 of the wafer W by suction is provided around the air suction pipe 42, which prevents the displacement of the wafer W. As a result, the use of the air suction pipe 42 makes it possible to locally reduce the grinding amount of a predetermined region (in the present embodiment, a region including the center of the wafer W).

A through hole functioning as the vent pipe 42CH is formed in the air suction pipe 42 according to the present embodiment, which makes it possible to displace the wafer W by generating negative pressure in this vent pipe 42CH by a known element such as an ejector. It is to be noted that the through hole formed in the air suction pipe 42 is formed independently of (without communicating with) the vent pipe 36CH communicating with the bottom surface of the chuck table 32. This configuration makes it possible to make a suction force for holding the wafer W by suction by the chuck table 32 and a suction force for displacing the wafer W by the air suction pipe 42 different from each other.

Figure 3C:
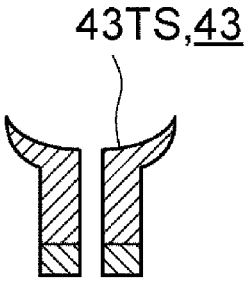

The tip surface 42TS, which faces the second surface WS2 of the wafer W, of the air suction pipe 42 according to the present embodiment has a smoothly curved convex surface. However, the tip surface 42TS is not limited to a convex surface. FIG. 3C shows an air suction pipe 43 according to a modification. As shown in FIG. 3C, a tip surface 43TS of the air suction pipe 43 may have a concave surface bowed toward the vent pipe (the center). This configuration makes it possible to increase a suction force by the air suction pipe 43.

The adjusting shaft 44 is configured to be able to displace the region including the center of the second surface WS2 of the wafer W in a direction in which the region moves closer to the grindstone 26 by moving the air suction pipe 42 in a direction in which the air suction pipe 42 moves closer to the grindstone 26 with respect to the adjusting shaft 44. Specifically, the adjusting shaft 44 has inside an actuator (not shown in FIG. 2), such as a servomotor or an air cylinder, for moving the air suction pipe 42 in the rotation axis direction and is configured to be able to move the air suction pipe 42 in the rotation axis direction by using this actuator. Moreover, a vent pipe communicating with the vent pipe 42CH of the air suction pipe 42 and connected to an ejector or the like that generates negative pressure in the vent pipe 42CH is formed in the adjusting shaft 44.

As shown in FIG. 3B, when the actuator of the adjusting shaft 44 moves the air suction pipe 42 in the direction in which the air suction pipe 42 moves closer to the grindstone 26 and thereby brings the tip surface 42TS of the air suction pipe 42 into contact with the region including the center of the second surface WS2, the region including the center of the second surface WS2 of the wafer W is displaced in the direction in which the region moves closer to the grindstone 26. When the region including the center of the second surface WS2 of the wafer W is displaced in the direction in which the region moves closer to the grindstone 26, the region including the center of the first surface WS1 is also displaced in the same direction, which makes it possible to increase the grinding amount in a central part of the first surface WS1 of the wafer W.

As will be described later, under normal conditions, by displacing the wafer W by 1 μm or less, it is possible to reduce variations in the thickness of the wafer W. Therefore, the amount of displacement of the wafer W in the normal line direction by the air suction pipe 42 is 1 μm or less.

The displacement unit according to the present embodiment further includes the air bag 46 for displacing the outer-side region of the wafer W in the normal line direction of the surface of the wafer W.

Figure 4A:
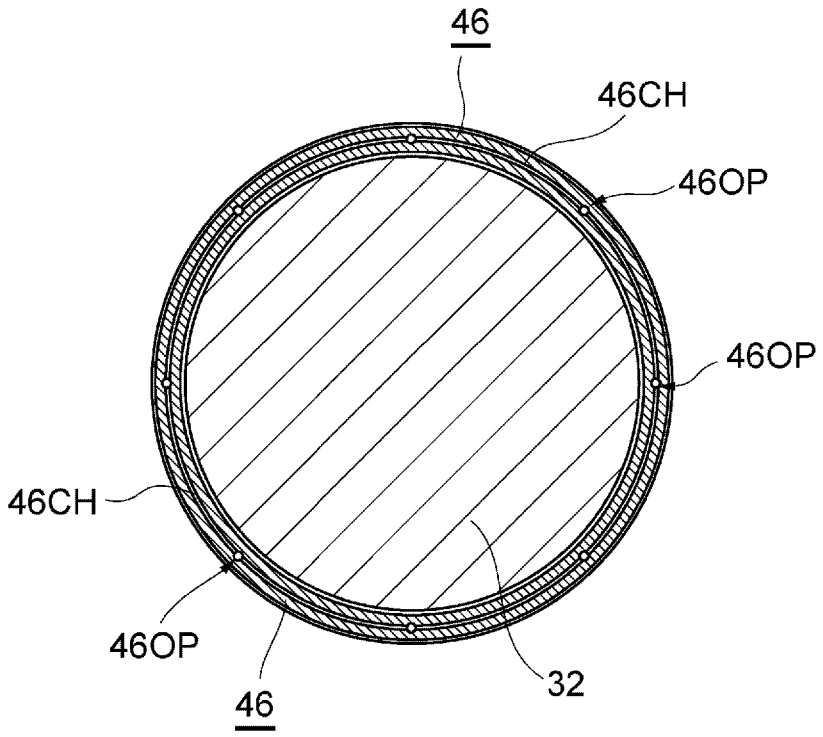
FIG. 4A is a plan view showing a chuck table and an air bag of the grinding apparatus according to the embodiment and FIG. 4B is a plan view showing a chuck table and an air bag of a grinding apparatus according to a modification, the chuck tables and the air bags viewed from above where the grindstone is disposed.
Figure 4B:
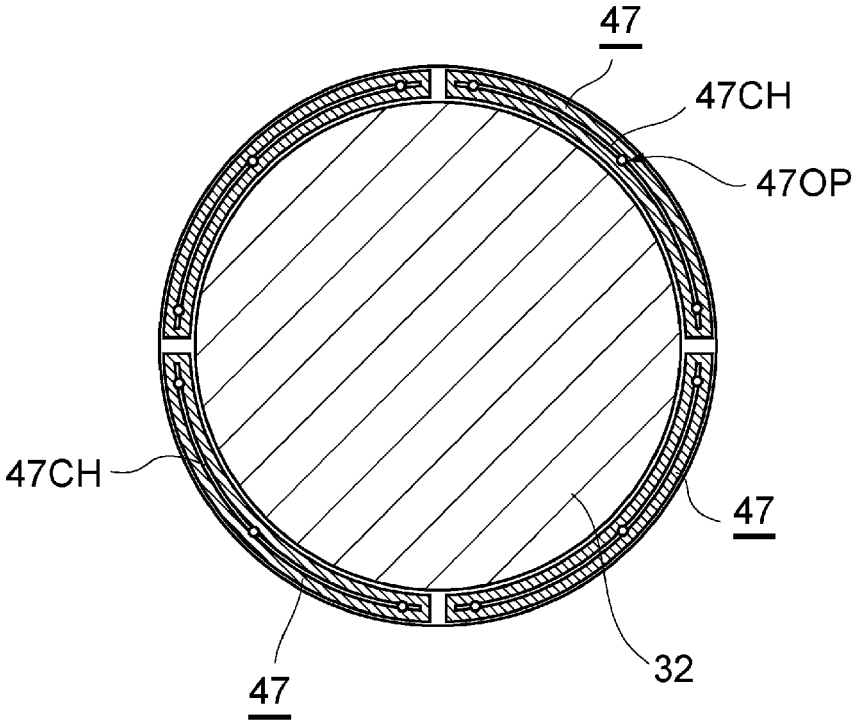

FIG. 4A is a plan view of the chuck table 32 and the air bag 46 which are viewed from above. FIG. 4B is a plan view showing an air bag 47 according to a modification. As shown in FIG. 4A, the air bag 46 is formed in the shape of a ring surrounding the lateral surface of the chuck table 32 formed in the shape of a disk. The vent pipe 46CH that communicates with a vacuum line BL provided in the chuck table 32 and extends in the circumferential direction is formed in the air bag 46. Moreover, a plurality of openings 460P provided apart from each other in the circumferential direction and communicating with the vent pipe 46CH are formed in a surface, which faces the second surface WS2 of the wafer W, of the air bag 46. As shown in FIG. 4A, for example, eight openings 460P provided 45 degrees apart from each other in the circumferential direction and communicating with the vent pipe 46CH are formed in the air bag 46. The air bag 46 is configured to be able to displace the outer-side region of the second surface WS2 of the wafer W in the direction away from the grindstone 26 by generating negative pressure in the vent pipe 46CH via the vacuum line BL in a state in which the openings 460P are close to the outer-side region of the second surface WS2 of the wafer W.

Furthermore, the air bag 46 is provided in such a way that the air bag 46 can expand and contract in the rotation axis direction. An internal space of the air bag 46 communicates with an air line AL provided in the chuck table 32 independently of the vent pipe 36CH for chucking and the vacuum line BL. The air bag 46 is configured such that, when gas (for example, air) is sent into the air bag 46 via the air line AL and the atmospheric pressure in the air bag 46 is increased, the air bag 46 expands in the rotation axis AX2 direction and pushes an outer part of the second surface WS2 of the wafer W by making contact therewith, thereby displacing the outer part of the wafer W in a direction in which the outer part moves closer to the grindstone 26. Meanwhile, the air bag 46 is configured such that, when the atmospheric pressure in the air bag 46 is reduced by discharging the gas from the air bag 46 via the air line AL, the air bag 46 contracts in the rotation axis AX2 direction and is separated from the second surface WS2 of the wafer W.

Therefore, by expanding the air bag 46, it is possible to displace the outer-side region of the wafer W in the direction in which the outer-side region moves closer to the grindstone 26, which makes it possible to increase the grinding amount of the outer-side region of the wafer W. Meanwhile, the air bag 46 is configured to be able to displace the outer-side region of the wafer W in the direction away from the grindstone 26 by contracting the air bag 46 and holding the wafer W by suction by generating negative pressure in the vent pipe 46CH in a state in which the openings are close to the outer-side region of the second surface WS2 of the wafer W. This also makes it possible to reduce the grinding amount of the outer-side region of the wafer W.

FIG. 4B shows a modification in which each of the air bag 47 and the vent pipe 47CH is divided into four parts in the circumferential direction. According to this modification, it is possible to independently displace four regions into which the outer-side region of the wafer W is divided. As a result, even when the grinding amount changes in the circumferential direction, it is possible to reduce variations in thickness.

Grinding Method

An example of a grinding method using the grinding apparatus 10 with the above-described configuration will be described below.

First, negative pressure is generated in the vent pipe 36CH communicating with the bottom surface of the chuck table 32 in a state in which the wafer W is placed on the circular conical surface of the chuck table 32 in such a way that the second surface WS2 of the wafer W faces the circular conical surface of the chuck table 32, whereby the chuck table 32 holds the wafer W by suction.

By driving the rotary driving portion in this state, the chuck table 32 and the wafer W held by the chuck table 32 start to rotate at several hundred rpm (for example, 100 to 900 rpm), for example.

Meanwhile, the spindle 22 starts to rotate at several thousand rpm (for example, 1000 to 9000 rpm), for example. As a result, the wheel 24 and the grindstone 26 attached to the wheel 24 also start to rotate. The spindle 22 moves in a direction in which the spindle 22 moves closer to the chuck table 32. The rotation axis AX2 of the chuck table 32 with respect to the rotation axis AX1 of the wheel 24 is adjusted in advance such that one of the generating lines of the slightly inclined circular conical surface of the chuck table 32 is nearly orthogonal to the rotation axis AX1 of the wheel 24 in a side view shown in FIG. 1A. Moreover, as shown in FIG. 1B, the wheel position with respect to the chuck table 32 is adjusted in advance such that the grindstone 26 passes through the central part of the first surface WS1 of the wafer W.

When the grindstone 26 makes contact with the first surface WS1 of the wafer W, the grindstone 26 starts to grind the first surface WS1 of the wafer W. Since the wafer W is also rotating, the grindstone 26 grinds the whole of the first surface WS1. As shown in FIG. 1B, since the grindstone 26 always passes through the central part of the first surface WS1 of the wafer W and the central part of the first surface WS1 of the wafer W corresponds to a position that gets closest to the grindstone 26 in a path of the grindstone 26, the grinding amount of the central part of the first surface WS1 of the wafer W sometimes becomes greater than those of the other regions.

When grinding is finished, the non-contact gage of the measuring portion 50 measures the thickness of the wafer W by irradiating the first surface WS1 of the wafer W with light. The non-contact gage measures the thickness of the wafer W in, for example, five different positions in a radial direction: a position L1 (a central part of the wafer W), a position L2 (an inner-side region of the wafer W away from the position L1 in an outside diameter direction), a position L3 (a radial middle part of the wafer W), a position L4 (an outer-side region of the wafer W away from the position L3 in the outside diameter direction), and a position L5 (an outer part of the wafer W) which are shown in FIG. 1B. The thickness of the wafer W corresponds to information indicating the grinding amount of the wafer W.

Figure 5A:
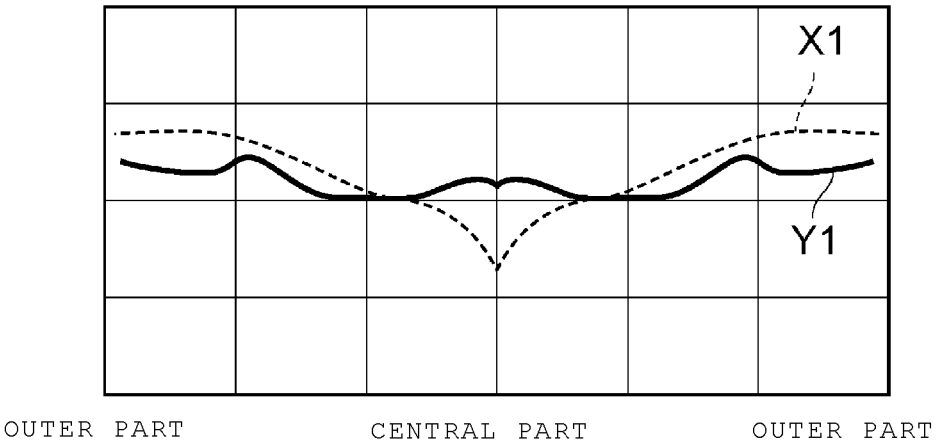
FIGS. 5A and 5B are surface profiles showing the thickness of the wafer after grinding and the thickness of the wafer after CMP, respectively.

A line X1 of FIG. 5A is an example of a surface profile of the wafer W after grinding. As indicated by the line X1, sometimes the central part of the wafer W is excessively ground and becomes thinner than the other regions in a range of 1 μm or less, for example. On the other hand, the central part of the wafer W sometimes becomes thicker than the other regions in a range of 1 μm or less, for example.

Then, the first surface WS1 of the wafer W is subjected to CMP (silicon CMP). When polishing is finished, an optical gage of a film thickness measuring device of a CMP polishing apparatus (or the non-contact gage of the measuring portion 50 of the grinding apparatus 10) measures the thickness of the wafer W in a diametral direction passing through the five positions: the positions L1 to L5 by irradiating the first surface WS1 of the wafer W with light.

Figure 5B:
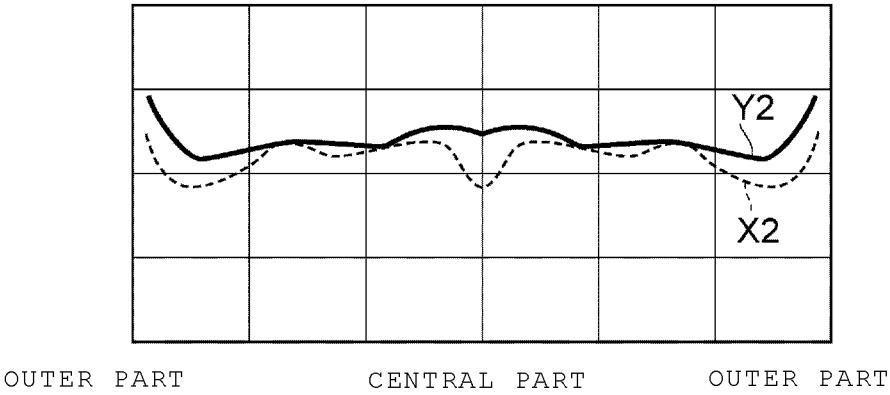

A line X2 of FIG. 5B is an example of a surface profile of the wafer W after CMP. As indicated by the line X2, since the outer part of the wafer W is less likely to be polished in CMP, the outer part sometimes becomes thicker than the other regions in a range of 1 μm or less, for example. On the other hand, sometimes the outer part of the wafer W is excessively polished and becomes thinner than the other regions in a range of 1 μm or less, for example.

Next, based on the information indicating the thicknesses of the wafer W in the positions L1 to L5 after grinding (an example of "information indicating cutting amounts") and/or the information indicating the thicknesses of the wafer W in the positions L1 to L5 after CMP (an example of "information indicating cutting amounts"), the amount of displacement of the central part of the second surface WS2 of the wafer W by the air suction pipe 42 and the adjusting shaft 44, which are the center displacement unit, and the amount of displacement of the outer part of the second surface WS2 of the wafer W by the air bag 46, which is the outer displacement unit, are determined. For example, the grinding apparatus 10 may include a storage device storing an algorithm or table that determines the amounts of displacement by the center displacement unit and the outer displacement unit with the amounts of displacement associated with the thicknesses of the wafer W in the positions L1 to L5 after grinding and after polishing, and may be configured to be able to determine control parameters of the air suction pipe 42, the adjusting shaft 44, and the air bag 46 based on this algorithm or table.

The grinding apparatus 10 is configured such that, when, for example, the thickness in the position L1 (the central part of the wafer W) is smaller than those of the other regions based on the information indicating the thicknesses of the wafer W in the positions L1 to L5 after grinding and is still smaller than those of the other regions even after CMP, the grinding portion 20 grinds second and subsequent wafers W in a state in which the center displacement unit displaces the region including the center of the second surface WS2 of the wafer W in the direction away from the grindstone 26.

Moreover, the grinding apparatus 10 is configured such that, when the thickness in the position L5 (the outer part of the wafer W) is smaller than those of the other regions based on the information indicating the thicknesses of the wafer W in the positions L1 to L5 after CMP, even when the thickness in the position L5 after grinding is similar to the thicknesses in the other regions, the grinding portion 20 grinds second and subsequent wafers W in a state in which the air bag 46, which is the outer displacement unit, displaces the outer-side region of the second surface WS2 of the wafer W in the direction away from the grindstone 26. As described above, by displacing the wafer W in grinding which is performed before CMP with consideration given to the information on thickness after CMP which is performed after grinding, it is possible to reduce variations in thickness after CMP.

A line Y1 of FIG. 5A is an example of a profile after grinding of a second wafer W and a line Y2 of FIG. 5B is an example of a profile after polishing of the second wafer W. As indicated by the line Y1 and the line Y2, it is possible to reduce excessive grinding of the central part and the outer part of the wafer W and reduce variations in thickness.

Conventional attempts to reduce variations in the cutting amount were made by units such as an angle adjusting unit configured to be able to change the rotation axis of the chuck table 32 with respect to the rotation axis of the wheel 24. However, since these units displace the whole surface of an object to be cut, an adjustment of the cutting amount of a certain region in the surface inevitably changes the cutting amounts of the other regions.

The cutting apparatus and the cutting method of the present embodiment prevent the displacement of the other regions which might be caused by the displacement of one region in a surface of an object to be cut, which makes it possible to prevent changes in the cutting amounts of the other regions. This makes it possible to cut the object to be cut in such a way that variations in thickness after cutting (after grinding or polishing) are reduced.

While the embodiment has been described with reference to specific examples, the disclosure is not limited to these specific examples. Any modification obtained by a person skilled in the art by appropriately making a design change to any of these specific examples is also included in the scope of the disclosure as long as it has a feature of the disclosure.

For example, a modification may be made in such a way that information indicating the thickness of the wafer W in the positions L1 to L5 (information indicating grinding amounts) is acquired during grinding of the wafer W and the first surface WS1 of the wafer W is cut in a state in which the second surface WS2 of the wafer W is displaced in the rotation axis direction of the rotation of the wheel 24 based on the acquired information.

Moreover, as described earlier, an object to be cut may be a semiconductor wafer with the second surface WS2 on which a semiconductor element is formed. In this case, the grinding method disclosed in the present embodiment may be applied to a downstream process.

Furthermore, the displacement unit may be configured to be able to displace a region other than the central part of the wafer W. In addition, the displacement unit may be configured to be able to displace the wafer W only in one direction (for example, only in the direction away from the grindstone 26).

Moreover, the grinding apparatus 10 and the grinding method according to the present embodiment may be used by being combined with another known grinding apparatus 10 and another known grinding method. For example, a grinding apparatus 10 and a grinding method which incline a chuck table 32 or a wheel 24 in such a way that a rotation axis of the chuck table 32 and a wafer W and a rotation axis of the wheel 24 and a grindstone 26 have a skew relationship are known. The grinding apparatus 10 and the grinding method according to the present embodiment may be used by being combined with another unit adopted in the other known grinding apparatus like that described above and the other known grinding method like that described above.

Second Embodiment

Hereinafter, a grinding apparatus and a grinding method according to the present embodiment will be described. It is to be noted that an element regarded as having a function or configuration identical or similar to that of the other embodiment is denoted by an identical or similar reference sign and an explanation thereof is omitted or simplified, and a difference from the other embodiment is mainly described.

Figure 6:
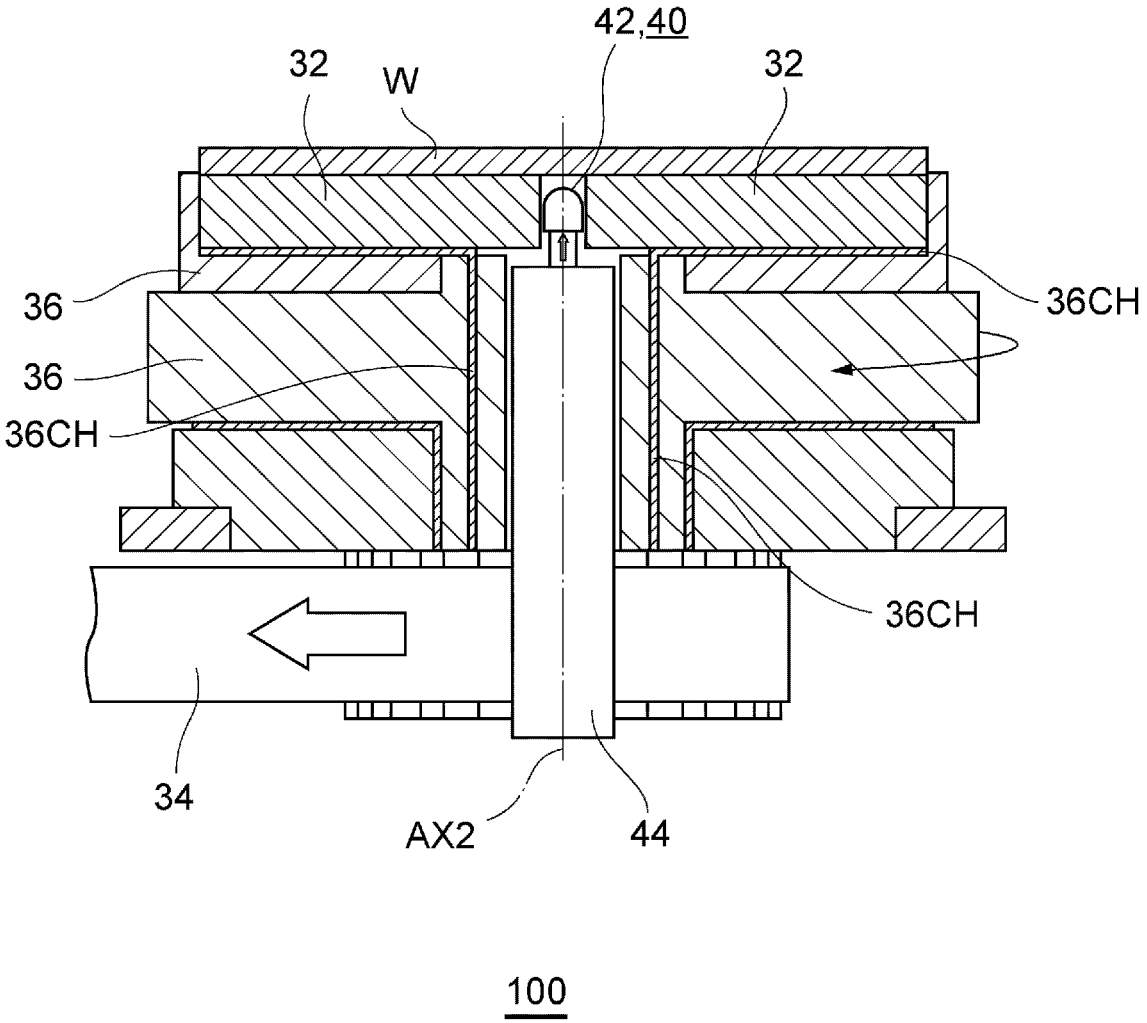
FIG. 6 is a schematic diagram showing a holding portion of a grinding apparatus according to another embodiment.

FIG. 6 is a sectional view schematically showing a holding portion of a grinding apparatus 100 according to the present embodiment. As shown in FIG. 6, the grinding apparatus 100 according to the present embodiment is different from the grinding apparatus 10 in that, although a displacement portion of the grinding apparatus 100 includes an air suction pipe 42 and an adjusting shaft 44 (i.e., a "center displacement unit"), the displacement portion does not include an element corresponding to an outer displacement unit.

With the grinding apparatus 100, by using the air suction pipe 42, it is possible to displace a region including the center of an object to be cut in a direction away from a grindstone or a direction in which the region moves closer to the grindstone, which makes it possible to locally reduce or increase the grinding amount of the region including the center.

In the present embodiment, the air suction pipe 42 is provided near the region including the center of a wafer W which is the object to be cut; the embodiment is not limited to this configuration. For example, in a cutting process in which a region that is excessively cut is a radial middle part, the air suction pipe 42 and other displacement units may be provided near the radial middle part.

Third Embodiment

Hereinafter, a grinding apparatus and a grinding method according to the present embodiment will be described.

The grinding apparatus according to the present embodiment is different from the grinding apparatus 10 in that, although a displacement portion of the grinding apparatus includes an outer displacement unit, the displacement portion does not include an element corresponding to a center displacement unit.

With this grinding apparatus, it is possible to displace an outer-side region of an object to be cut in a direction away from a grindstone or a direction in which the outer-side region moves closer to the grindstone, which makes it possible to locally reduce or increase the grinding amount of the outer-side region.

While the embodiments have been described with reference to specific examples, the disclosure is not limited to these specific examples. Any modification obtained by a person skilled in the art by appropriately making a design change to any of these specific examples is also included in the scope of the disclosure as long as it has a feature of the disclosure. The elements of the above specific examples and the arrangement, conditions, shapes, and the like thereof are not limited to those illustrated above and may be changed as appropriate. The combination of the elements of the above specific examples may be changed as appropriate unless a technical contradiction arises.

While certain embodiments have been described, these embodiments have been presented by way of example only, and are not intended to limit the scope of the disclosure. Indeed, the novel embodiments described herein may be embodied in a variety of other forms; furthermore, various omissions, substitutions and changes in the form of the embodiments described herein may be made without departing from the spirit of the disclosure. The accompanying claims and their equivalents are intended to cover such forms or modifications as would fall within the scope and spirit of the disclosure.

What is claimed is:

1. A production apparatus comprising:

a rotating body configured to rotate a grindstone to cut a first surface of an object;

a chuck table configured to contact a second surface of the object; and a displacement portion in contact with a central portion of the second surface of the object and configured to displace at least a portion of the second surface of the object in a rotation axis direction of the rotating body.

2. The production apparatus according to claim 1, wherein the displacement portion includes a center displacement portion configured to displace the central portion of the second surface in the rotation axis direction.

3. The production apparatus according to claim 2, wherein the center displacement portion is configured to displace the center portion of the second surface in a direction away from the grindstone.

4. The production apparatus according to claim 1, wherein the displacement portion includes an outer displacement portion configured to displace an outer-side region of the second surface in the rotation axis direction.

5. The production apparatus according to claim 4, wherein the displacement portion is configured to displace the outer-side region of the second surface in a direction away from the grindstone.

6. The production apparatus according to claim 1, wherein the object includes a silicon wafer.

7. A production method comprising:

cutting a first surface of an object by rotating a grindstone, with a second surface of the object being held;

acquiring information indicating a cutting amount in a plurality of positions on the first surface;

with a central portion of the second surface of the object or at least one portion of a second surface of a second object being in contact with a displacement portion, displacing the second surface of the object or the at least one portion of the second surface of the second object in a rotation axis direction of the grindstone based on the acquired information; and cutting the first surface of the object or a first surface of the second object by rotating the grindstone with the displaced second surface of the object being held or with the displaced second surface of the second object being held.

8. The production method according to claim 7, wherein the step of displacing includes displacing a center of the second surface of the object or the second object in the rotation axis direction.

9. The production method according to claim 7, wherein the step of displacing includes displacing an outer-side region of the second surface of the object or the second object in the rotation axis direction.

10. The production method according to claim 7, wherein the object includes a silicon wafer.

* * * * *